US005186278A

United States Patent [19]

Ives et al.

[11] Patent Number: 5,186,278

[45] Date of Patent: Feb. 16, 1993

[54] OIL MIST SEPARATOR

[75] Inventors: Steven E. Ives, Durand; Thomas B. Ascroft, Laingsburg; Richard F. Reising; Robert F. Hill, both of Troy; John E. Brevick, Livonia; Eric W. Schneider, Shelby Township, Macomb County, all of Mich.

[73] Assignee: General Motors Corporation, Detroit, Mich.

[21] Appl. No.: 811,901

[22] Filed: Dec. 20, 1991

Related U.S. Application Data

[63] Continuation-in-part of Ser. No. 631,711, Dec. 21, 1990, abandoned.

[51] Int. Cl.[5] ..... F01M 11/08

[52] U.S. Cl. ..... 184/6.23; 123/572; 123/573

[58] Field of Search ..... 184/6.21, 6.23, 6.24; 55/183, 184, 185; 123/572, 573, 41.86

[56] References Cited

U.S. PATENT DOCUMENTS

| | | | |
|---|---|---|---|
| 2,225,652 | 12/1940 | Miller | 123/196 |
| 2,903,087 | 9/1959 | Glasgow | 55/184 |
| 3,234,925 | 2/1966 | Cahn | 123/573 |
| 3,326,198 | 6/1967 | Jackson et al. | 123/119 |
| 3,469,565 | 9/1969 | Weber et al. | 123/119 |
| 3,524,437 | 8/1970 | Crandall | 123/573 |
| 3,875,916 | 4/1975 | Patton | 123/119 |
| 3,877,904 | 4/1975 | Lowrie | 55/184 |
| 4,401,093 | 8/1983 | Gates, Jr. et al. | 123/572 |
| 4,602,607 | 7/1986 | Balsley | 123/574 |
| 4,627,406 | 12/1986 | Namiki et al. | 123/573 |
| 4,667,747 | 5/1987 | Ohtaka et al. | 123/573 |
| 5,024,203 | 6/1991 | Hill | 123/572 |

FOREIGN PATENT DOCUMENTS

| | | | |
|---|---|---|---|
| 2855904 | 7/1980 | Fed. Rep. of Germany | 55/184 |
| 0287156 | 3/1971 | U.S.S.R. | 55/185 |

*Primary Examiner*—Ira S. Lazarus
*Assistant Examiner*—Alan Cariaso
*Attorney, Agent, or Firm*—Gordon F. Belcher

[57] ABSTRACT

An oil mist separator for a gas flow having oil particles suspended therein, comprising a separator element including a duct having an open end, a closed end and a the wall extending between said open and closed ends. The separator element further comprises a longitudinal axis extending between the open and closed ends with the longitudinal axis being parallel to the side wall. The separator element includes an inlet orifice formed in the side wall and a drain orifice formed in the side wall between the inlet orifice and closed end. The separator element also includes an impingement plate mounted within the side wall, with the impingement plate extending upward from the closed end a sufficient distance so that the impingement plate faces the inlet orifice. The separator element is supported in the gas flow so that the longitudinal axis is approximately vertical and the closed end is below the open end, and so that the gas flow enters the separator element through the inlet orifice and strikes the impingement plate resulting in the oil particles adhering to the impingement plate and flowing downward toward the closed end with the oil particles exiting from the separator element through the drain orifice, and the gas flow exits the separator element through the open end.

4 Claims, 2 Drawing Sheets

OIL MIST SEPARATOR

This is a continuation-in-part of Ser. No. 07/631,711 filed Dec. 21, 1990, now abandoned.

TECHNICAL FIELD

This invention relates to an oil mist separator for a gas flow having oil particles suspended therein.

BACKGROUND

Internal combustion engines often include a positive crankcase ventilation (PCV) system comprising a PCV passage which allows communication between the crankcase, valve cover or a chamber connected thereto, and the intake system. This enables gas in these parts of the engine to flow to the intake system and cylinders resulting in improvements in emissions and possibly minor improvements in engine efficiency. The PCV system usually includes a PCV valve which regulates the gas flow through the PCV passage to the intake system.

The gas which enters the PCV passage and flows to the cylinders can have oil particles suspended therein. Such oil particles can travel through the PCV line, with the gas, to the intake system and cylinders in which they are burned with the air and fuel. If the amount of such oil particles becomes excessive, the engine emissions can increase and the engine efficiency can decrease.

Therefore, PCV systems can include a filter device for separating oil particles from the gas flow through the PCV passage to reduce the amount of oil which flows to the cylinders. Such a filter device can include a semi-permeable filter element through which the gas flows. The filter element typically has small openings or interstices through which the gas and oil must pass. The openings are sized so that the oil is strained from the gas and remains in the filter element The filter element can become clogged with oil and thereby obstruct the gas flow therethrough. Also, when gas flows through a filter element that contains oil from earlier filtrations, oil can become re-mixed with the gas thereby reducing the net amount of oil removed from the gas by the filter element.

Such filter devices also typically require a separate return passage to enable the oil which is separated from the gas to drain from the filter device. Such return passages can add complexity to the PCV system design, construction and maintenance.

SUMMARY OF THE INVENTION

The present invention provides an oil mist separator for a gas flow having oil particles suspended therein. The oil mist separator comprises a separator element including a duct having an open end, a closed end and a side wall extending between said open and closed ends. The separator element further comprises a longitudinal axis extending between the open and closed ends with the longitudinal axis being parallel to the side walls. The separator element includes an inlet orifice formed in the side wall and a drain orifice formed in the side wall between the inlet orifice and closed end. The separator element also includes an impingement plate mounted within the side wall, with the impingement plate extending upward from the closed end a sufficient distance so that the impingement plate faces the inlet orifice. The separator element is supported in the gas flow so that the longitudinal axis is approximately vertical and the closed end is below the open end, and so that the gas flow enters the separator element through the inlet orifice and strikes the impingement plate resulting in the oil particles adhering to the impingement plate and flowing downward toward the closed end with the oil particles exiting from the separator element through the drain orifice, and the gas flow exits the separator element through the open end.

The oil mist separator does not require the gas flow, which has oil particles suspended therein, to pass through a semi-permeable filter element which strains the oil particles from the gas flow. The obstruction which can result from clogging of such a filter element with oil is therefore absent. Also, re-mixing of the gas flow with oil contained in such a filter element does not occur. Moreover, the oil mist separator does not require a separate return passage to enable oil to be drained from the oil mist separator.

These and other features and advantages of the invention will be more fully understood from the following description of certain specific embodiments of the invention taken together with the accompanying drawings.

BRIEF DRAWING DESCRIPTION

In the drawings.

Corresponding reference characters indicate corresponding parts throughout the several views of the drawings.

DETAILED DESCRIPTION

Figure 1:
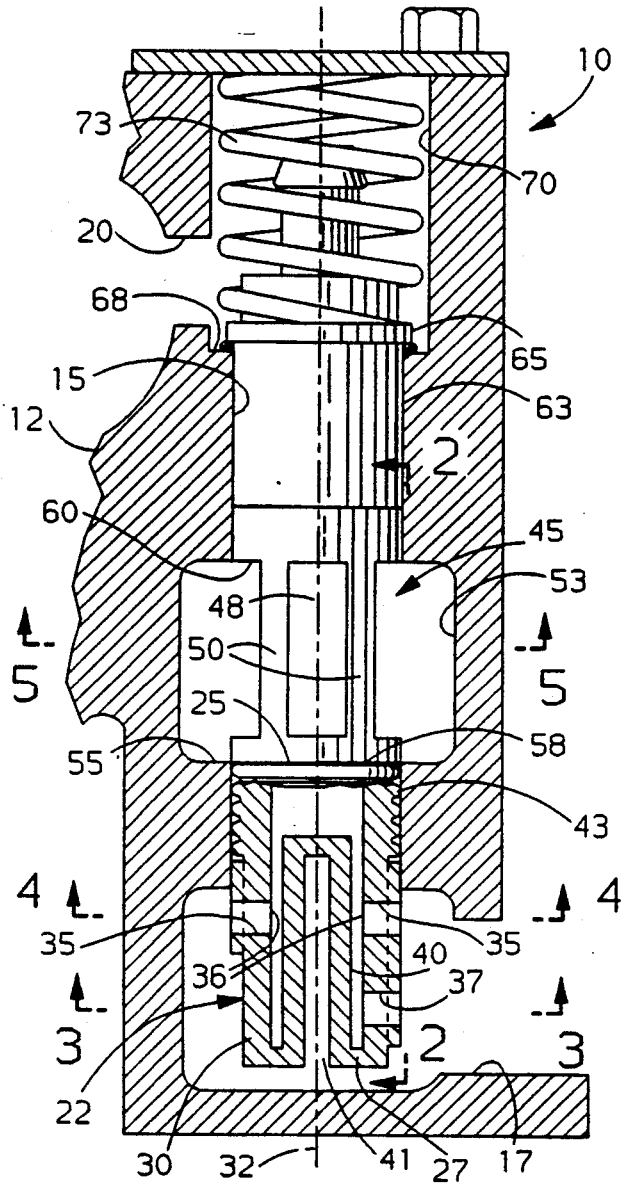
FIG. 1 is a sectional view showing an oil mist separator of the present invention mounted in a housing.

In FIG. 1, numeral 10 generally refers an oil mist separator of the present invention. The oil mist separator 10 is well-suited for use in a PCV system to remove oil which can be suspended in the gas flow therethrough. The embodiment of the oil mist separator 10 described and illustrated can be used with a PCV system. The oil mist separator 10 can be used in other systems, however, in which it is desirable to remove oil particles from a gas flow in which they are suspended. All dimensions shown in the drawings are in millimeters (mm).

The oil mist separator 10 is mounted in a housing 12 having a gas passage 15 therethrough which is formed so that the cross section of the gas passage varies along its length. A gas inlet 17 is connected to the gas passage 15 adjacent one of its ends. A gas outlet 20 communicates with the opposite end of the gas passage 15.

The oil mist separator 10 comprises a separator element 22 including a duct having an open end 25, a closed end 27 and a side wall 30 extending between the open and closed ends. The separator element 22 shown in FIG. 1 is roughly cylindrical although it may have a non-circular cross section. The separator element 22 has an outer diameter approximately equal to 13.6 mm. The separator element 22 has a longitudinal axis 32 extending between the open and closed ends 25, 27. The longitudinal axis 32 is parallel to the side walls 30.

Figure 2:
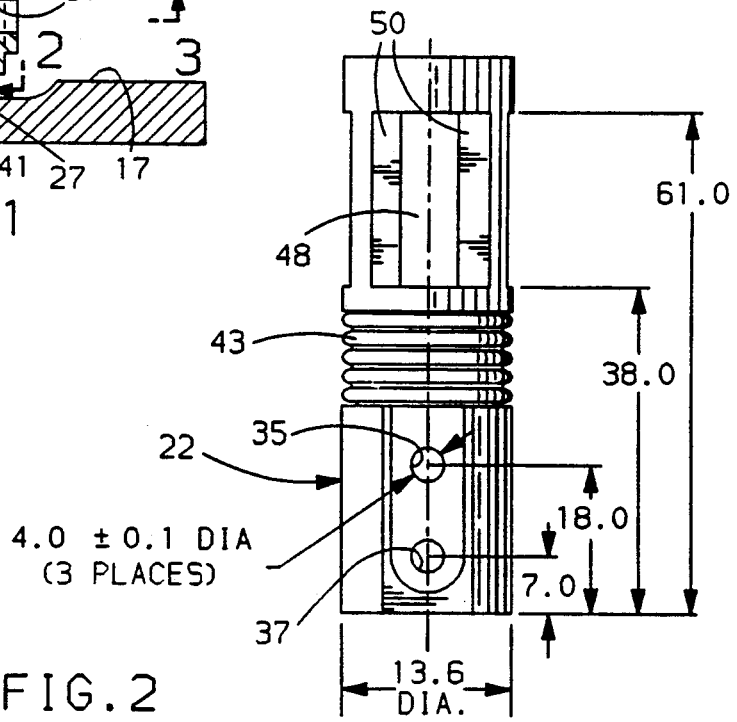
FIG. 2 is a view showing the oil mist separator in the plane indicated by line 2—2 of FIG. 1 showing the separator and ported element removed from the housing.
Figure 3:
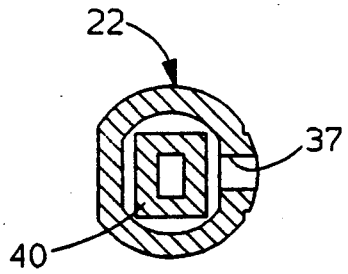
FIG. 3 is a cross sectional view of the oil mist separator in the plane indicated by the line 3—3 of FIG. 1 showing the separator element, drain orifice and impingement plate.

The separator element 22 has a pair of inlet orifices 35 formed in opposite sides of the side wall 30. The side wall 30 has a sufficient thickness so that the inlet orifices 35 form nozzles. Each inlet orifice 35 has an inlet orifice outlet 36 in the plane of the inner surface of the side wall 30. Each inlet orifice 35 is spaced approximately 18.0 mm from the closed end 27, as shown in FIG. 2. The diameter of each inlet orifice 35 is approximately 4.0 mm, as shown in FIG. 2.

A drain orifice 37 is formed in the side wall 30 between the closed end 27 and the inlet orifices 35. The drain orifice 37 is spaced approximately 7.0 mm from the closed end 27, as shown in FIG. 2.

The separator element 22 is disposed in the gas passage 15 with the inlet orifices 35 adjacent the gas inlet 17, as shown in FIG. 1. The longitudinal axis 32 of the separator element 22 is vertical and the closed end 27 is below the open end 25. A seal 43 comprising annular ridges is formed adjacent to the open end 25 of the separator element 22. The clearance between the upper end of the separator element 22 and the gas passage 15 is sufficient to allow relative axial movement between the separator element and gas passage.

Figure 4:
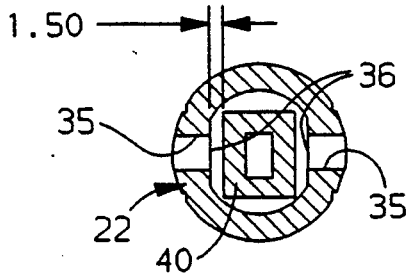
FIG. 4 is a cross sectional view of the oil mist separator in the plane indicated by the line 4—4 of FIG. 1 showing the separator element, inlet orifices and impingement plate.

An impingement plate 40 extends upward from the closed end 27 within the side wall 30. The impingement plate 40 extends away from the closed end 27 a sufficient distance so that the impingement plate faces the inlet orifices 35. The impingement plate 40 comprises a duct having a rectangular cross section concentric with the separator element 22. The end of the impingement plate 40 nearest the open end 25 is closed. The closed end 27 has an end port 41 enabling access to the interior of the impingement plate 40. This enables the impingement plate 40 to be integral with the closed end 27 since the impingement plate can be formed around a core which can be removed through the end port 41. The impingement plate 40 is spaced approximately 1.50 mm from the inlet orifice outlet 36, as shown in FIG. 4.

Figure 5:
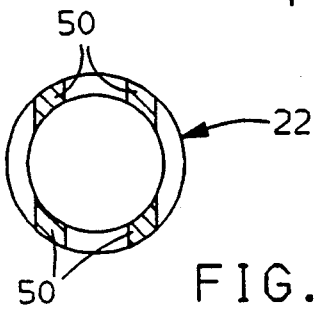
FIG. 5 is a cross sectional view of the oil mist separator in the plane indicated by the line 5—5 of FIG. 1 showing the ported element.

The oil mist separator 10 further comprises a ported element 45 including a duct which is integrally formed with the separator element 22 adjacent the open end 25. The ported element 45 communicates with the separator element 22 via the open end 25. The ported element 45 has four ports 48 formed by vertical posts 50. The edges of the posts 50 are parallel to one another and each is collinear with an edge of another post, as shown in FIG. 5. This enables formation of the posts 50 by molding the posts around an elongate cylindrical core which is abutted by elongate rectangular cores. After the posts 50 are formed, the rectangular cores are pulled away from the cylindrical core and the cylindrical core is pulled out from within the posts. The lower edge of each port 48 is approximately 38.0 mm from the closed end 27 and the upper edge of each port is approximately 61.0 mm from the closed end, as shown in FIG. 2.

The ported element 45 extends through a plenum chamber 53 formed by an enlarged portion of the gas passage 15 above the separator element 22. The plenum chamber 53 has a chamber outlet 60, and a bottom 55 with a chamber inlet 58 formed therein. The ported element 45 extends between the chamber inlet and outlet 58, 60. The clearances between the upper and lower ends of the ported element 45, and the gas passage 15 are sufficient to allow relative axial movement between the ported element and gas passage.

The plenum chamber 53 is roughly cylindrical and has an inner diameter approximately equal to 25–40 mm. The ports 48 enable communication between the ported element 45 and plenum chamber 53.

A positive crankcase ventilation (PCV) valve 63 is disposed in the gas passage 15 above the ported element 45. The ported element 45 communicates with the PCV valve 63 via the gas passage 15. The ported element 45 is not attached to the PCV valve 63. The PCV valve 63 has a collar 65 which sits on a step 68 formed in the gas passage 15 to support the PCV valve. An O-ring is disposed between the collar 65 and step 68.

The gas passage 15 has a stop socket 70 which communicates with the gas outlet 20. A helical spring 73 having a plurality of coils is seated in the stop socket. The helical spring 73 urges the collar 65 into engagement with the step 68 to axially fix the PCV valve 63 in the gas passage 15.

Axial displacement of the separator and ported elements 22, 45 in the gas passage 15 is limited by the PCV valve 63 and the bottom of the gas passage 15.

OPERATION

The separator element 22 is supported in the gas flow so that the gas enters the separator element through the inlet orifices 35 and strikes the impingement plate 40 resulting in the oil particles suspended in the gas flow adhering to the impingement plate and flowing downward toward the closed end 27. The nozzles which are formed by the inlet orifices 35 are shaped to direct the incoming gas toward the impingement plate 40.

The oil particles exit the separator element 22 through the drain orifice 37. The spacing of the drain orifice 37 above the closed end 27 provides space under the drain orifice into which the oil can drain from the separator element 22. The spacing of the inlet orifices 35 above the drain orifice 37 allows oil to collect in the separator element 22 without obstructing the inlet orifices 35. The gas exits the separator element 22 through the open end 25. The seal 43 obstructs the flow of gas from the gas inlet 17 directly into the plenum chamber 53 without first flowing through the separator element 22.

The communication between the separator and ported elements 22, 45 allows the gas in the separator element to rise into the ported element and flow, via the ports 48, into the plenum chamber 53. The plenum chamber 53 has a sufficiently large volume so that the velocity of the gas flow is slowed causing the oil particles to fall downward through the open end 25 into the separator element 22. The oil particles are able to continue to fall through the separator element 22 to the closed end 27 with the oil particles exiting the separator element 22 through the drain orifice 37. The ported element 45 is longitudinally aligned in the plenum chamber 53 so that the ports 48 are sufficiently close to the bottom 55 to limit the amount of oil particles which collect in the plenum chamber below the ports.

It is possible to use the separator element 22 without the ported element 45. In such a construction, the separator element 22 communicates with the plenum chamber 53 via the open end 25 and chamber inlet 58.

The gas flow rises out of the plenum chamber 53 through the chamber outlet 60 and flows through the gas passage 15 into the PCV valve 63. The 0-ring between the collar 65 and step 68 obstructs the flow of gas from the ported element 45 directly into the stop socket 70 without flowing through the PCV valve 63. The PCV valve 63 regulates the gas flow through the gas passage 15. The gas flow which exits the PCV valve 63 flows between the coils of the helical spring 73 and exits the stop socket 70 through the gas outlet 20.

The gas flow rate through the gas inlet 17 is preferably between approximately one and three cubic feet per minute. If the gas flow rate is much below this range, then the impact of the gas on the impingement plate 40 may not have sufficient force to cause the oil particles to adhere to the impingement plate and flow downward toward the closed end 27. If the gas flow rate is much above this range, the gas can flow into the drain orifice 37 as well as the inlet orifices 35 and thereby obstruct the flow of oil out of the drain orifice.

ALTERNATIVE EMBODIMENTS

Figure 6:
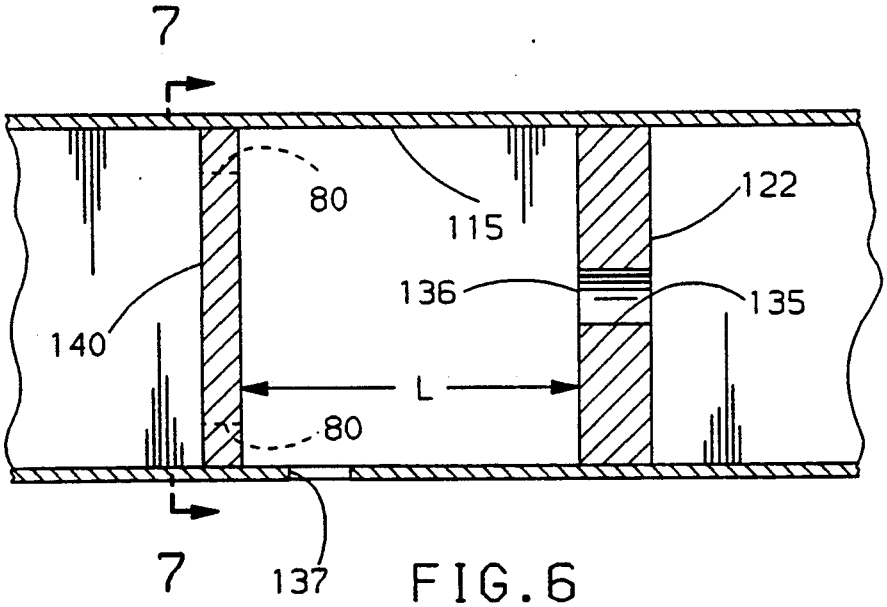
FIG. 6 is a schematic view showing an alternative embodiment of the oil mist separator shown in FIG. 1.

An alternative embodiment of the oil mist separator 110 is shown in FIG. 6. Parts similar to those shown in FIGS. 1-5 have the same reference numeral with the addition of the prefix 100. The oil mist separator 110 includes a separator element 122 comprising a plate having an inlet orifice 135 with an inlet orifice outlet 136. The separator element 122 is mounted in the gas passage 115 so that communication between the portions of the gas passage on opposite sides of the separator element is possible only via the inlet orifice 135. The inlet orifice 135 is preferably circular. The gas passage 115 ordinarily has a flow restriction, such as a control valve, and in such systems, the cross sectional area of the inlet orifice 135 is between approximately 1.1 and 1.2 times the cross sectional area of the flow restriction. If the control valve has a variable size restriction, then the cross sectional area of the inlet orifice 135 is between approximately 1.1 and 1.2 times the maximum possible area of the variable size restriction. The inlet orifice 135 is preferably somewhat larger than the maximum flow area of the PCV valve so that the oil mist separator 110 does not significantly alter the gas flow rate characteristics of the PCV system. The inlet orifice 135, however, is preferably as small as possible to produce the highest possible PCV gas velocities downstream of the inlet orifice outlet 136.

Alternatively, the inlet orifice 135 can also serve as a fixed area flow restriction for the gas passage 115. If the inlet orifice 135 has such a function, the cross sectional area of the inlet orifice is determined by the desired gas flow characteristics of the PCV system. One such gas flow characteristic is the gas flow rate through the gas passage 115, which is between approximately 1.5 and 4 cubic feet per minute at highest engine intake manifold vacuum. Other gas flow rates through the gas passage 115 are possible and can be affected by the engine size.

Figure 7:
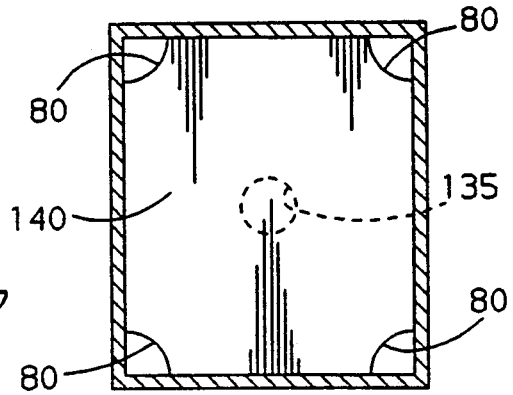
FIG. 7 is a view showing the oil mist separator in the plane indicated by line 7—7 of FIG. 6 showing the impingement plate and plate ports.

The oil mist separator 110 further comprises an impingement plate 140 mounted in the gas passage 115 so that the impingement plate faces the inlet orifice outlet 136. The impingement plate 140 has four plate ports 80 to allow communication between the portions of the gas passage 115 on opposite sides of the impingement plate. The plate ports 80 are formed by removing the corners of a rectangular impingement plate 140, as shown in FIG. 7. The distance L between the inlet orifice outlet 136 and impingement plate 140 is approximately equal to 1.4 times the square root of the cross sectional area of the inlet orifice 135. The distance L may also be equal to the diameter of the inlet orifice 135 multiplied by 0.25 or 0.8. The distance l is preferably sufficiently large to provide as large a pressure drop as possible across the inlet orifice 135 resulting in the PCV gas velocity being as high as possible. The distance L, however, is also sufficiently small so that the PCV gas strikes the impingement plate 140 before its velocity is substantially reduced to reduce reintroduction of the oil particles into the PCV gas. The impingement plate 140 is preferably vertical and perpendicular to the axis of the inlet orifice 135.

A drain orifice 137 is formed in the lower surface of the gas passage 115 below the inlet orifice 135. A return passage may register with the drain orifice 137 and extend from the gas passage 115.

The gas flow through the gas passage 115 flows through the inlet orifice 135 and strikes the impingement plate 140 resulting in the oil particles adhering to the impingement plate and flowing downward toward the lower surface of the gas passage 115. The gas flow rate through the gas passage 115 is between approximately 1.5 and 4 cubic feet per minute. The oil particles drain from the gas passage 115 through the drain orifice 137 and flow into the return passage if one is connected to the drain orifice. The gas flows past the impingement plate 140 through the plate ports 80.

Oil mist separators 110 similar to that shown in FIGS. 6 and 7 were tested to determine their effectiveness in separating oil from PCV gas. The oil mist separators 110 which were tested included an inlet plate mounted across the gas passage 115 upstream of the separator element 122 so that it covered the gas passage. The inlet plate had an inlet port which allowed gas flow into the gas passage 115. The oil mist separators 110 which were tested further included on outlet plate mounted across the gas passage 115 downstream of the impingement plate 140 so that it covered the gas passage. The outlet plate had an outlet port which allowed gas flow out of the gas passage 115. Connected to the face of the outlet plate opposite from the separator element 122 was a PCV valve which controlled the gas flow through the outlet port. The PCV valve used was AC Type CV-769C; the inlet orifice 135 having an 0.63 cm diameter was 15% larger than the maximum flow area of this PCV valve. Also, the lower surface of the gas passage 115 was inclined downward toward the inlet plate to cause the oil to collect in the region of the gas passage adjacent to the inlet plate. The drain orifice 137 preferably adjoins this region and is connected to a conduit enabling the oil to drain back to the sump of the engine.

Test I

The first set of tests involved eight different oil mist separators 110, each of which consisted of a different combination of the following features:

the volume of the gas passage 115 between the inlet and outlet plates was 98 $cm^3$ in four of the oil mist separators 110 and 655 $cm^3$ in the other four oil mist separators.

the area of the inlet orifice 135 was 0.65 $cm^2$ (0.91 cm diameter) in four of the oil mist separators 110 and 6.45

$cm^2$ (2.87 cm diameter) in the other four oil mist separators.

four of the oil mist separators 110 had a permeable filter adjoining the side of the inlet plate facing the separator element 122, and the other four oil mist separators did not have such a filter.

Each oil mist separator 110 had an impingement plate 140 which was downstream from the separator element 122 and 0.8 cm from the inlet orifice outlet 136. Following are the amounts of oil collected in these oil mist separators 110 when similar PCV gas flows were directed through them.

| Oil collected in oil mist separator | | | |
|---|---|---|---|
| Gas passage volume | Orifice | Filter | Oil collected (mL) |
| s | s | n | 0.56 |
| s | s | y | 1.28 |
| s | l | n | 0.26 |
| s | l | y | 0.70 |
| l | s | n | 0.59 |
| l | s | y | 0.55 |
| l | l | n | 0.17 |
| l | l | y | 0.45 |

key: s = small, l = large, n = no, and y = yes

These results indicate that the oil mist separators 110 having a small gas passage 115 volume between the inlet and outlet plates, a small inlet orifice 135 in the separator element 122, and a filter between the inlet plate and separator element most effectively separated oil from the PCV gas.

Test II

A second set of tests involved four different oil mist separators 110 each of which consisted of a different combination of the following features:

two of the oil mist separators 110 had an inlet orifice 135 area of 0.31 $cm^2$ (0.63 cm diameter), and the other two oil mist separators had an inlet orifice area of 0.65 $cm^2$ (0.91 cm diameter).

two of the oil mist separators 110 had a permeable filter adjoining the side of the inlet plate facing the separator element 122, and the other two oil mist separators did not have such a filter.

Each oil mist separator 110 had an impingement plate 140 which was downstream from the separator element 122 and 0.8 cm from the inlet orifice outlet 136. The volume of the gas passage 115 between the inlet and outlet plates in each oil mist separator 110 was 98 $cm^3$. Following are the oil collection results for these oil mist separators 110 when similar PCV gas flows were directed through them, with the PCV gas exiting each oil mist separator flowing through the PCV valve.

| PCV oil consumption material balance | | | | | |
|---|---|---|---|---|---|
| Inlet Orifice Area | 0.31 $cm^2$ | | 0.65 $cm^2$ | | None* |
| Filter used | No | Yes | No | Yes | No |
| Oil through PCV valve, mL | 5.41 | 5.76 | 6.93 | 6.51 | 7.80 |
| Oil collected in oil mist separator, mL | 1.43 | 1.87 | 0.67 | 1.54 | — |
| Total oil, mL | 6.84 | 7.63 | 7.60 | 8.05 | 7.80 |
| Percent of oil accounted for | 88% | 98% | 97% | 103% | 100% |
| Percent of oil collected in oil mist separator | 18% | 24% | 9% | 20% | — |

*Standard PCV configuration with no oil mist separator 110.

These results indicate that both of the oil mist separators 110 having a 0.31 $cm^2$ inlet orifice 135 area, and the oil mist separator having a 0.65 $cm^2$ inlet orifice area with a filter between the inlet plate and separator element 122 most effectively removed oil from the PCV gas.

Test III

A third set of tests involved an oil mist separator 110 including a single separator element 122, having an inlet orifice 135 with a 0.63 cm diameter, which was sandwiched between a first pair of permeable filters. The first pair of filters adjoined opposite sides of the separator element 122. The separator element 122 and first pair of filters was then further sandwiched between a second pair of permeable filters with each of the second pair of filters adjoining a respective one of the first pair of filters. The separator element 122 and four filters were then sandwiched between the inlet and outlet plates with the inlet plate adjoining one of the second pair of filters and the outlet plate adjoining the other of the second pair of filters. The filters and separator element 122 can adjoin one another or be spaced apart. The volume of the gas passage 115 between the inlet and outlet plates was 98 $cm^3$.

In the resulting laminated structure, PCV gas first flows through the inlet port, through the two filters upstream of the separator element 122, through the inlet orifice 135, through the other two filters downstream of the separator element, and through the outlet port.

following are the amounts of oil collected in the four filters of this oil mist separator 110 when PCV gas was directed through it. The filters are numbered consecutively from the filter adjoining the inlet plate (filter no. 1) to the filter adjoining the outlet plate (filter no. 4).

| Oil collected | |
|---|---|
| Component | Oil Volume, mL |
| Bulk Oil | 1.60 |
| Filter #1 | 1.40 |
| Filter #2 | 0.10 |
| Filter #3 | 1.30 |
| Filter #4 | 0.03 |
| Total | 4.43 |

The bulk oil component indicates the amount of liquid oil (as opposed to oil mist) that flowed from the valve cover to the oil mist separator 110. This occurred predominantly at 4000 rpm and 4 inches Hg manifold vacuum where the engine speed and gas flow through the oil mist separator 110 were the greatest. The increased amount of oil collected on filter #3 was due to the high gas velocity (approximately 3000 cm/second) exiting the inlet orifice 135. Without the inlet orifice 135, it is possible that filter #3 would have collected very little oil as was evident by the small amount of oil collected on filter #4.

The oil mist separator 110 was 57% effective in removing oil from the PCV gas. The effectiveness of the oil mist separator 110 without the separator element 122 was estimated to be 40%.

The effectiveness of filter no. 3 indicates that a filter can be an effective substitute for the impingement plate 140. The most effective oil mist separator 110 might therefore consist of a series of filters and a separator element 122 having a small diameter inlet orifice 135 disposed between each adjoining pair of filters.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The embodiments of the invention in which an exclusive property or privilege is claimed are defined as follows:

1. An oil mist separator for a gas flow having oil particles suspended therein, comprising:

a separator element including a duct having an open end, a closed end and a side wall extending between said open and closed ends;

a longitudinal axis extending between said open and closed ends, said longitudinal axis being parallel to said side wall;

an inlet orifice formed in said side wall;

a drain orifice formed in said side wall between said inlet orifice and closed end; and an impingement plate mounted within said side wall, said impingement plate being parallel to said longitudinal axis and facing said inlet orifice and drain orifice, said separator element being supported in the gas flow so that said longitudinal axis is approximately vertical and said closed end is below said open end, and so that the gas flow enters said separator element through said inlet orifice and strikes said impingement plate, the gas flow also entering said drain orifice and striking said impingement plate when said drain orifice is open, the striking of the gas flow against the impingement plate resulting in the oil particles adhering to said impingement plate and flowing downward toward said closed end with the oil particles exiting from said separator element through said drain orifice, and the gas flow exits said separator element through said open end, said drain orifice being sufficiently spaced apart from said inlet orifice so that when said drain orifice is blocked with oil, the velocity of the gas flow adjacent to said drain orifice is approximately zero.

2. An oil mist separator as set forth in claim 1 wherein said inlet orifice has an inlet orifice outlet which faces said impingement plate, and said impingement plate is spaced approximately 1.50 mm from said inlet orifice outlet.

3. An oil mist separator for a gas flow having oil particles suspended therein, comprising:

a separator element including a duct having an open end, a closed end and a side wall extending between said open and closed ends;

a longitudinal axis extending between said open and closed ends, said longitudinal axis being parallel to said side wall;

a pair of diametrically spaced inlet orifices formed in said side wall;

a drain orifice formed in said side wall between said inlet orifices and closed end;

an impingement plate mounted within said side wall, said impingement plate extending upward from said closed end a sufficient distance so that said impingement plate is disposed between said inlet orifices and drain orifice, said side wall having a circular cross section and said impingement plate having a hollow cross section, said separator element being supported in the gas flow so that said longitudinal axis is approximately vertical and said closed end is below said open end, and so that the gas flow enters said separator element through said inlet orifices and strikes said impingement plate, the gas flow also entering said drain orifice and striking said impingement plate when said drain orifice is open, the striking of the gas flow against the impingement plate resulting in the oil particles adhering to said impingement plate and flowing downward toward said closed end with the oil particles exiting from said separator element through said drain orifice, and the gas flow exits said separator element through said open end, wherein oil particles which adhere to said impingement plate and flow downward can accumulate in said separator element below said inlet orifices thereby substantially reducing any obstruction, caused by the oil particles, to the gas flow entering into said inlet orifices; and a plenum chamber having a bottom surface and a chamber inlet formed therein enabling communication between said plenum chamber and separator element via said open end and chamber inlet so that gas in said separator element can rise into said plenum chamber, said plenum chamber having a sufficiently large volume so that the velocity of the gas flow therein is slowed causing the oil particles to fall downward through said open end into said separator element, through said separator element to said closed end with the oil particles exiting said separator element through said drain orifice.

4. An oil mist separator for a gas flow having oil particles suspended therein, comprising:

a separator element including a duct having an open end, a closed end and a side wall extending between said open and closed ends;

a longitudinal axis extending between said open and closed ends, said longitudinal axis being parallel to said side wall;

an inlet orifice formed in said side wall;

a drain orifice formed in said side wall between said inlet orifice and closed end;

an impingement plate mounted within said side wall, said impingement plate extending upward from said closed end a sufficient distance so that said impingement plate faces said inlet orifice, said separator element being supported in the gas flow so that said longitudinal axis is approximately vertical and said closed end is below said open end, and so that the gas flow enters said separator element through said inlet orifice and strikes said impingement plate resulting in the oil particles adhering to said impingement plate and flowing downward toward said closed end with the oil particles exiting from said separator element through said drain orifice, and the gas flow exits said separator element through said open end;

a plenum chamber having a bottom surface and a chamber inlet formed therein enabling communication between said plenum chamber and separator element via said open end and chamber inlet so that gas in said separator element can rise into said plenum chamber, said plenum chamber having a sufficiently large volume so that the velocity of the gas flow therein is slowed causing the oil particles to fall downward through said open end into said separator element, through said separator element to said closed end with the oil particles exiting said separator element through said drain orifice wherein said chamber has a chamber outlet; and a ported element including a duct in said plenum chamber extending between said chamber inlet and outlet, said ported element engaging said separator element adjacent said open end, said ported element communicating with said separator element via said open end, said ported element having side ports enabling communication between the interior of said ported element and said plenum chamber, said side ports being sufficiently close to said bottom surface so that oil particles in said plenum chamber can flow into said ported element.

* * * * *